US006205740B1

(12) United States Patent
Ekerholm et al.

(10) Patent No.: US 6,205,740 B1
(45) Date of Patent: Mar. 27, 2001

(54) SUPPORTING ELEMENT AND METHOD FOR MANUFACTURING THE SAME

(75) Inventors: Bengt Ekerholm, Vejbystrand; Hans Larsson, Helsingborg; Ingmar Svensson, Ängelholm, all of (SE)

(73) Assignee: Lindab AB (Publ), Bastad (SE)

( * ) Notice: Subject to any disclaimer, the term of this patent is extended or adjusted under 35 U.S.C. 154(b) by 0 days.

(21) Appl. No.: 09/150,849

(22) Filed: Sep. 10, 1998

Related U.S. Application Data

(63) Continuation of application No. PCT/SE97/00417, filed on Mar. 12, 1997.

(30) Foreign Application Priority Data

Mar. 12, 1996 (SE) ..... 9600950

(51) Int. Cl.[7] ..... E04C 3/09

(52) U.S. Cl. ..... 52/733.2; 52/731.9; 52/364; 52/481.1; 52/670; 29/897.312; 29/897.33; 29/897.35

(58) Field of Search ..... 52/733.2, 731.9, 52/731.8, 731.7, 733.3, 364, 481.1, 670, 671, 672; 29/6.1, 897.3, 897.31, 897.312, 897.33, 897.35

(56) References Cited

U.S. PATENT DOCUMENTS

| | | | | |
|---|---|---|---|---|
| 2,706,315 | | 4/1955 | Price . | |
| 3,094,197 | * | 6/1963 | Attwood | 52/733.2 X |
| 3,108,406 | | 10/1963 | Ellis . | |
| 3,129,792 | | 4/1964 | Gwynne . | |
| 3,333,379 | * | 8/1967 | Harris | 52/364 |
| 3,812,558 | | 5/1974 | Watanabe . | |
| 3,956,998 | * | 5/1976 | Bavetz | 52/506.02 X |
| 4,011,704 | * | 3/1977 | O'Konski | 52/733.3 |
| 4,016,700 | * | 4/1977 | Blomstedt | 52/481.1 X |
| 4,513,551 | | 4/1985 | Gauffin et al. . | |
| 4,619,098 | | 10/1986 | Taylor . | |
| 4,713,921 | * | 12/1987 | Minialoff et al. | 52/731.9 X |
| 5,207,045 | | 5/1993 | Bodnar . | |
| 5,315,804 | * | 5/1994 | Attalla | 52/731.1 |
| 5,605,024 | | 2/1997 | Sucato et al. . | |
| 5,687,538 | * | 11/1997 | Frobosilo et al. | 52/731.7 |
| 5,797,233 | * | 8/1998 | Hascall | 52/481.1 |

FOREIGN PATENT DOCUMENTS

| | | | | |
|---|---|---|---|---|
| 625693 | * | 8/1961 | (CA) | 52/364 |
| 117804 | | 3/1966 | (CS) . | |
| 124465 | | 9/1967 | (CS) . | |

OTHER PUBLICATIONS

"Tak–väggkatalogen 94" (*Ceiling Wall Catalogue*) issued in 1994 by Lindab AB.

* cited by examiner

*Primary Examiner*—Laura A. Callo
(74) *Attorney, Agent, or Firm*—Weingarten, Schurgin, Gagnebin & Hayes LLP

(57) ABSTRACT

An elongate supporting element has a cross section with a web (9) and two side flanges (10, 11) for the supporting of building panels or the like. The web (9) has an elongate, stress-equalising zone (4) which extends wholly or partly between the two outer ends (8*a,* 8*b*) of the supporting element and by means of which the supporting element (8) is reinforced.

29 Claims, 1 Drawing Sheet

FIG I
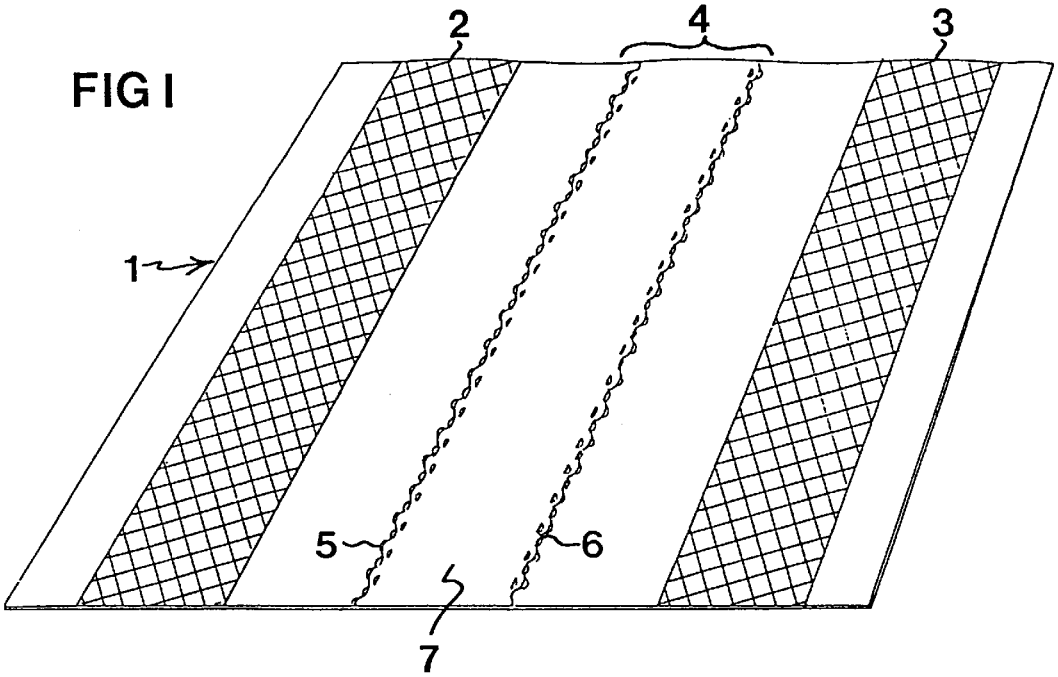
FIG 2
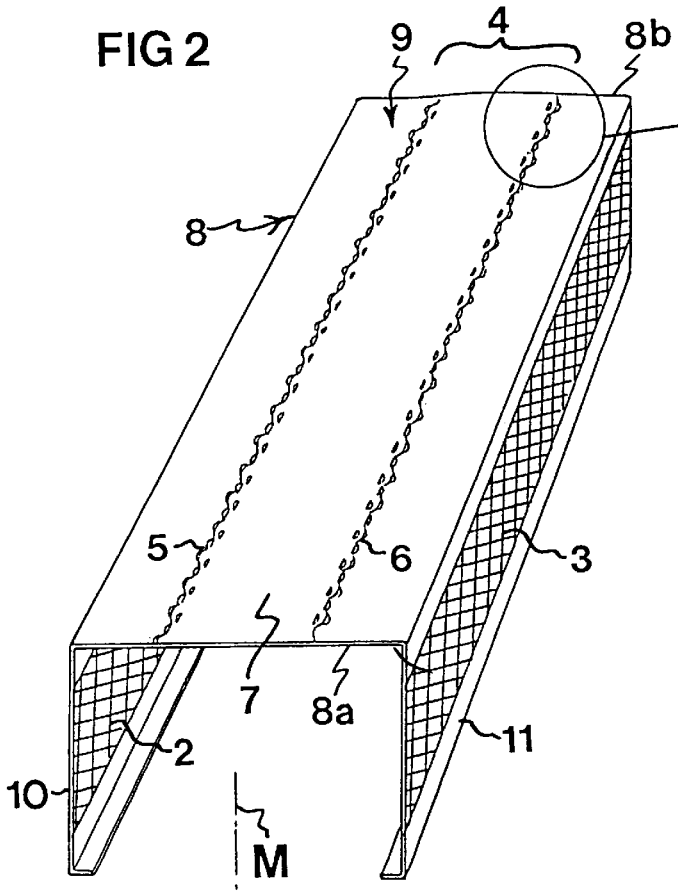
FIG 3
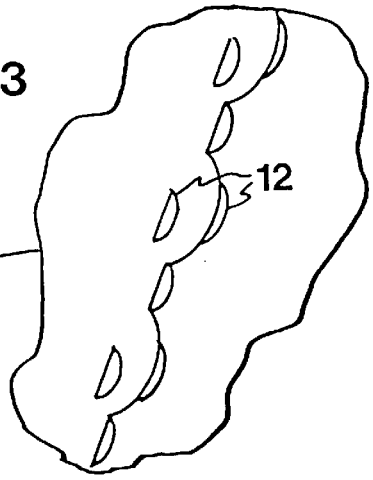
FIG 4
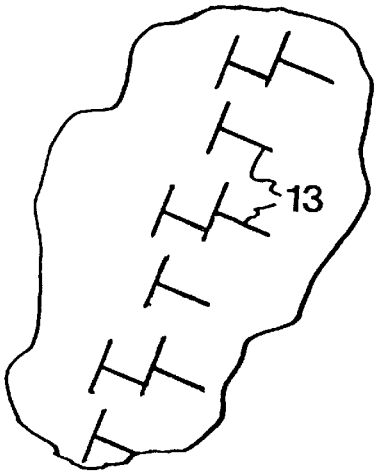

SUPPORTING ELEMENT AND METHOD FOR MANUFACTURING THE SAME

CROSS-REFERENCE TO RELATED APPLICATIONS

This is a continuation of International Application PCT/SE97/00417, with an international filing date of Mar. 12, 1997, which claims priority to Swedish application 9600950-1 filed Mar. 12, 1996.

TECHNICAL FIELD

The present invention relates to a supporting element for building of walls comprising building panels and the like. The invention also concerns a method for manufacturing such a supporting element.

BACKGROUND ART

Supporting elements of this type are described in the "Tak-väggkatalogen" ("Ceiling Wall Catalogue") issued in 1994 by Lindab AB, which shows the mounting of so-called building studs on pp 105–107 and which shows various arrangements of vertical studs and horizontal bars cooperating therewith on pp 108–109. Further examples of supporting elements in the field of the invention are shown on e.g. pp 113 and 119 in the above-mentioned catalogue. The term "supporting element" is used below as a conception of studs, sections and bars etc. for the building of walls, especially walls where building panels are mounted on supporting elements.

Furthermore Swedish Published Application SE-B457,223 (corresponding to U.S. Pat. No. 4,513,551) discloses a supporting element of U-shaped cross-section comprising a web and two side flanges for supporting building panels or the like. To facilitate the driving-in of fastening screws when mounting building panels on the supporting element (cf. the Lindab Catalogue p. 105), the side flanges have areas of so-called expanded metal which guide the fastening screws (cf. FIG. 1 in SE-B-457,223).

Such supporting elements as described above are manufactured from a flat sheet-metal blank which, in a special forming process, is formed to U-shaped cross-section. In this forming, undesired internal stress often arises in the supporting element, which may result in the entire supporting element becoming twisted, which renders the mounting operation difficult. In supporting elements of the type shown in SE-B-457,223, the expanded metal in the flanges may cause special stress which, if the worst comes to the worst, causes the free longitudinal edges of the flanges to become twisted or wave-shaped. This wave shape may arise even when the two areas of expanded metal are formed on the flat sheet-metal blank, whose longitudinal edges in unfavourable cases obtain a wave shape of such great amplitude (about 40 mm) that the handling of the strip-shaped sheet-metal blank as well as the forming into the desired supporting element are rendered difficult.

There is thus a need of a new supporting element which tends to a less extent to be twisted and which does not have the above-mentioned undesired wave shape.

A further general desire, which is well known to the expert, is that the supporting element should have good rigidity and withstand the linear loads perpendicular to the flanges, which arise during mounting and also when subjecting the finished wall to loads. Various measures have been suggested for the reinforcing of supporting elements, and examples are shown on p. 113 in the Lindab catalogue mentioned by way of introduction, in which the web of the supporting stud has been provided with two parallel longitudinal reinforcements in the form of grooves.

However, the market now requires still more rigid supporting elements, which is the starting point of this invention. There is a need of a new type of supporting element, which has improved strength and rigidity and whose flanges in particular are reinforced such that they yield towards each other to a smaller extent when subjected to loads, for instance when mounting building panels thereon.

As a further example of prior art, mention can be made of the supporting element according to U.S. Pat. No. 4,619,098, which for the purpose of reducing the heat and cold conductivity is formed with slits. The above-described inconvenience, i.e. undesired internal stress and insufficient rigidity, however, is not discussed in this reference.

SUMMARY OF THE INVENTION

The object of the present invention is to suggest a solution to the above-described problems and consequently provide an improved supporting element.

In a accordance with the present invention, an elongate supporting element includes first and second flange portions and a non-coplanar web portion that shares a first common edge with said first flange portion and a second common edge with said second flange portion, said web including a plurality of rows of deformations that extend at least partly through the web and defined a stress-equalising zone.

Providing the inventive supporting element with a stress-equalizing zone having rows of deformations in the web results in better rigidity and capacity of withstanding loads compared with prior-art supporting elements of a similar kind. Particularly good results have been achieved by an embodiment where the stress-equalizing zone is given the form of two elongate portions, which are narrow in relation to the width of the web and which are parallel with the side flanges and each consist of a number of close cuts arranged in rows and extending wholly or partly through the material of the web, said narrow portions defining between themselves unmachined material of the web without cuts. A comparative experiment with such a supporting element will be briefly discussed below.

A 2400-mm-long supporting element of thin metal sheet according to the above-mentioned embodiment, where the flanges of the supporting element have areas of expanded metal, was supported at its ends and subjected to a linear load of 500 N/m. A corresponding prior-art supporting element, essentially according to FIG. 2 in SE-B457,223, thus having expanded-metal flanges but a completely unmachined-web, was subjected to load in the same fashion. The deflection in the centre of the supporting element according to the invention was only half as great as the deflection of the prior-art supporting element (about 5 mm compared with about 10 mm).

According to the invention, a straight supporting element is obtained, which has good rigidity and no such wave shape as in the prior-art supporting element. The previous undesired internal stress of the supporting element is eliminated or changed thanks to the stress-equalizing zone in the web of the supporting element.

BRIEF DESCRIPTION OF THE DRAWING

The invention and its many advantages will be described in more detail below with reference to the accompanying schematic drawing, which shows preferred embodiments.

FIG. 1 is a perspective view of a flat sheet-metal blank.

FIG. 2 is a perspective view of a supporting element according to the invention manufactured from the sheet-metal blank illustrated in FIG. 1.

FIG. 3 shows on a larger scale a portion of the web of the supporting element.

FIG. 4 is a view, similar to FIG. 3, of an alternative embodiment of the web of the supporting element.

DESCRIPTION OF PREFERRED EMBODIMENTS

In FIG. 1, a blank of thin metal sheet is generally designated 1, which in a manner known per se comprises two expanded-metal areas 2, 3 which are spaced from the two longitudinal edges of the sheet-metal blank 1. Between the expanded-metal areas 2, 3, the sheet-metal blank 1 has a stress-equalizing or stress-changing zone 4 having rows of deformations, which in this embodiment comprise two elongate portions 5, 6, each consisting of a large number of close cuts arranged in rows and extending wholly or partly through the sheet-metal blank 1, as will be described in more detail below. The two portions 5, 6 define between themselves an area 7 of unmachined material without cuts.

In a manner known per se, the sheet-metal blank 1 shown in FIG. 1 is formed into a supporting element according to the invention, which is generally designated 8 and is shown in FIG. 2. The elongate supporting element 8 is given a U-shaped cross-section comprising a web 9 and two side flanges 16, 11 for the supporting of building panels or the like (not shown). The expanded-metal areas 2, 3 of the side flanges 10, 11 facilitate the driving-in of fixing elements, such as fastening screws or the like, for fixing the building panels. In some cases the building panels can also be attached by gluing (not shown). It should be noted in the context that the invention is applicable also to supporting elements without such expanded-metal areas in the flanges.

The stress-equalizing zone 4 is preferably symmetrically arranged in respect of a center plane M extending through the supporting element 8 perpendicular to the web 9.

FIG. 2 clearly shows how-the stress-equalizing zone 4 is placed on the web 9. According to a preferred embodiment, the stress-equalizing zone 4 comprises two elongate portion 5, 6, which are narrow in relation to the width of the web 9 and which are parallel with the side flanges 10, 11 and each consist of a large number of close cuts 12 arranged in rows and extending wholly or partly through the material of the web 9 (see FIG. 3). As mentioned above, the narrow portions 5, 6 define an area 7 of unmachined material of the web 9 without cuts.

It should be emphasised that the cuts 12 shown in FIG. 3 can be of a different design and consist of other deformations or distortions of the material, such as embossed portions, slits etc, or combinations thereof. An alternative embodiment is shown in FIG. 4, where the cuts consist of T-shaped slits 13 arranged in rows and being, to some extent, relatively offset. It will be appreciated that several other types of cuts or distortions are possible; the important thing is that the web 9 of the supporting element 8 is provided with a stress-equalizing zone having rows of deformations which result in improved rigidity and which reduce the risk of twisting of the supporting element and the occurrence of wave shape thereof. It should be particularly mentioned that the narrow portions 5, 6 with cuts must not necessarily extend all the way from one outer end 8*a* of the supporting element 8 to the other end 8*b*. In a variant (not shown) these portions 5, 6 can extend merely along part of the length of the web 9, or intermittently.

According to an embodiment of the invention, which is not shown in more detail, the stress-equalizing zone 4 comprises several narrow portions 5, 6 of the above-mentioned type, arranged in pairs, preferably equidistantly spaced from said center plane M. The number of narrow portions with cuts is not decisive of the invention as long as a suitable stress-equalizing zone is provided in the web.

In a method of manufacturing, according to an embodiment of the invention, from a flat sheet-metal blank 1 a supporting element 8 according to FIG. 2, the flat sheet-metal blank 1 is provided with its stress-equalizing zone 4 in the form of a number of elongate portions 5, 6 which are narrow in relation to the width of the web 9 and which are arranged in parallel with and spaced from each other and which are formed by cutting a large number of close cuts 12 or 13 arranged in rows and extending wholly or partly through the material of the web 9. In this method, the side flanges 10, 11 of the supporting element 8 can preferably be formed with expanded-metal areas 2, 3.

Finally, one more advantage of the inventive supporting element should be mentioned. The stress-equalizing zone in the web has, in practical experiments, been found to have a favourable effect on the sound-absorbing capacity of the supporting element. This side-effect is so advantageous that the supporting element provided according to the invention can be said to constitute a combination of a supporting stud and a stud which in technical language is called sound-absorbing stud.

The inventive concept is in no way restricted to the embodiments and variants described above, but a plurality of modifications are conceivable within the scope of the inventive idea as expressed in the appended claims. It should be particularly emphasised that the invention is applicable to several types of supporting elements, as discussed by way of introduction. The cross-section of the supporting element is not decisive of the invention, but may be U-, C- or Z-shaped, etc. Moreover, the stress-equalizing zone in the web of the supporting element can within the scope of the invention be provided in ways other than described above.

What is claimed is:

1. An elongate supporting element, comprising:

a first flange portion;

a second flange portion; and a web portion that shares a first common edge with said first flange portion and shares a second common edge with said second flange portion, said web portion being disposed in a different plane than said first flange portion and said second flange portion and including a plurality of rows of deformations that define a stress-equalizing zone, said rows of deformations each comprise a plurality of close cuts that are sufficiently small, of sufficient shape, and sufficiently closely spaced within a row to provide the stress-equalizing zone, and the stress-equalizing zone including a region of unmachined material without cuts.

2. The supporting element of claim 1, wherein the first and second common edges are in parallel and the rows of deformations are arranged in parallel with the first and second common edges.

3. The supporting element of claim 1, wherein the stress equalizing zone is symmetrically arranged relative to a center plane (M) that is perpendicular to the web and that bisects the web along a line that is parallel to the first and second common edges.

4. The supporting element of claim 3, including a plurality of pairs of rows of deformations that are equidistantly spaced from said center plane (M).

5. The supporting element of claim 1, wherein the first and second flange portions comprise expanded metal.

6. The supporting element of claim 1, wherein said first and second flange portions and said web portion are formed from a single thin metal sheet.

7. The supporting element of claim 1, wherein the rows of deformations are each narrower than said region of unmachined material.

8. The supporting element of claim 1, wherein the deformations are arc-shaped.

9. The supporting element of claim 1, wherein the deformations are T-shaped.

10. The supporting element of claim 1, wherein the deformations extend wholly through the web portion.

11. The supporting element of claim 1, wherein the deformations extend partly through the web portion.

12. The supporting element of claim 1, wherein a cumulative width of said rows of deformations occupies less than half of a width of the web portion.

13. A method of manufacturing an elongate supporting element from a flat sheet-metal blank, comprising the steps of:

forming a plurality of rows of deformations on said blank, said rows of deformations each comprise a plurality of close cuts that are sufficiently small, of sufficient shape, and sufficiently closely spaced within a row to provide a stress-equalizing zone;

bending a first section of said blank along a first edge that is parallel to at least one of said rows of deformations; and bending a second section of said blank along a second edge that is parallel to at least one of said rows of deformations such that a third section of said blank is disposed between said first and second sections of said blank, said rows of deformations being on said third section of said blank, the stress-equalizing zone further including a region of unmachined material without cuts.

14. The method of claim 13, wherein said step of forming deformations includes the step of disposing the rows of deformations in parallel by cutting a plurality of close cuts at least partially through said third section of said blank.

15. The method of claim 13, wherein said steps of bending the first and second sections of the blank include bending until said first and second sections are each substantially perpendicular to said third section of the blank.

16. The method of claim 13, further including the step of expanding at least a portion of said first and second sections of said blank.

17. The method of claim 13, wherein the rows of deformations are each narrower than said region of unmachined material.

18. The method of claim 13, wherein the deformations are arc-shaped.

19. The method of claim 13, wherein the deformations are T-shaped.

20. The method of claim 13, wherein the deformations extend wholly through the third section.

21. The method of claim 13, wherein the deformations extend partly through the third section.

22. The method of claim 13, wherein a cumulative width of said rows of deformations occupies less than half of a width of the third section.

23. An elongate supporting element, comprising:

a first planar portion;

a second planar portion; and a third planar portion that shares a first common edge with said first planar portion and a second, opposing common edge with said second planar portion, said third planar portion being in a different plane than said first planar portion and said second planar portion and including a plurality of rows of deformations, the rows of deformations each comprising a plurality of close cuts, the rows being parallel to both said first and second common edges, said third planar portion further including a region of unmachined material without cuts, the deformations being sufficiently small, of sufficient shape, and sufficiently closely spaced within a row to define thereby a stress-equalizing zone between and including said rows of deformations, said stress-equalizing zone including said region of unmachined material, wherein the stress-equalizing zone is symmetrically arranged relative to a center plane (M) that is perpendicular to the third planar portion and that bisects the third planar portion along a line that is parallel to the first and second common edges.

24. The supporting element of claim 23, wherein the rows of deformations are each narrower than said region of unmachined material.

25. The supporting element of claim 23, wherein the deformations are arc-shaped.

26. The supporting element of claim 23, wherein the deformations are T-shaped.

27. The supporting element of claim 23, wherein the deformations extend wholly through the third planar portion.

28. The supporting element of claim 23, wherein the deformations extend partly through the third planar portion.

29. The supporting element of claim 23, wherein a cumulative width of said rows of deformations occupies less than half of a width of the third planar portion.

* * * * *